US011588289B2

(12) United States Patent
Jurek et al.

(10) Patent No.: US 11,588,289 B2
(45) Date of Patent: Feb. 21, 2023

(54) REMOVABLE DEVICE FOR RETAINING ELECTRICAL CONTACTS

(71) Applicants: Continental Automotive France, Toulouse (FR); Continental Automotive GmbH, Hannover (DE)

(72) Inventors: Gilles Jurek, Plaisance du Touch (FR); Christian Kempf, Toulouse (FR); Thomas Perrin, Roquettes (FR)

(73) Assignees: Continental Automotive France, Toulouse (FR); Continental Automotive GmbH, Hannover (DE)

( * ) Notice: Subject to any disclaimer, the term of this patent is extended or adjusted under 35 U.S.C. 154(b) by 764 days.

(21) Appl. No.: 16/476,914

(22) PCT Filed: Jan. 16, 2018

(86) PCT No.: PCT/FR2018/050095
§ 371 (c)(1),
(2) Date: Jul. 10, 2019

(87) PCT Pub. No.: WO2018/134509
PCT Pub. Date: Jul. 26, 2018

(65) Prior Publication Data

US 2019/0334307 A1 Oct. 31, 2019

(30) Foreign Application Priority Data

Jan. 18, 2017 (FR) ..... 1750374

(51) Int. Cl.
*H01R 43/20* (2006.01)
*H01R 12/70* (2011.01)
(Continued)

(52) U.S. Cl.
CPC ..... *H01R 43/205* (2013.01); *H01R 12/707* (2013.01); *H01R 13/20* (2013.01); *H01R 43/0256* (2013.01); *H01R 43/0263* (2013.01)

(58) Field of Classification Search
CPC .. H01R 12/707; H01R 13/20; H01R 43/0256; H01R 43/0263; H01R 43/205
See application file for complete search history.

(56) References Cited

U.S. PATENT DOCUMENTS 4,525,015 A 6/1985 Schwindt
5,208,968 A * 5/1993 Camsell ..... H01R 43/205 29/739

(Continued)

FOREIGN PATENT DOCUMENTS

CN 101946372 A 1/2011
CN 103181033 A 6/2013

(Continued)

OTHER PUBLICATIONS

Chinese Office Action for Chinese Application No. 201880007575.2, dated Apr. 27, 2021 with translation, 9 pages.

(Continued)

*Primary Examiner* — Carl J Arbes
(74) *Attorney, Agent, or Firm* — RatnerPrestia

(57) ABSTRACT

A removable device for retaining electrical contacts, having: a rigid element for holding electrical contacts including a plurality of housings that are configured to accept the electrical contacts, the lateral walls of the holding element that are adjacent to the housings having a plurality of openings that each lead into one housing of the plurality of housings of the holding element; and an elastic element for retaining the electrical contacts in the holding element including a plurality of sprung blades that are arranged facing the openings leading into the housings of the rigid holding element so as to retain the electrical contacts in the (Continued)

housings of the holding element. The invention further relates to a soldering method implementing such a device.

12 Claims, 3 Drawing Sheets

(51) Int. Cl.
*H01R 13/20* (2006.01)
*H01R 43/02* (2006.01)

(56) References Cited

U.S. PATENT DOCUMENTS

| | | | | |
|---|---|---|---|---|
| 5,373,626 | A | 12/1994 | Youngfleish | |
| 5,964,596 | A * | 10/1999 | Vicich | H01R 43/205 439/943 |
| 6,168,454 | B1 | 1/2001 | Dzwonczyk | |
| 6,383,032 | B1 * | 5/2002 | Gerberding | H01R 13/645 439/681 |
| 7,431,603 | B1 * | 10/2008 | Szmidt | H01R 4/4836 439/441 |
| 7,690,923 | B2 | 4/2010 | Horchler et al. | |
| 8,986,037 | B2 | 3/2015 | Boemmel et al. | |
| 9,660,406 | B2 * | 5/2017 | King, Jr. | H01R 13/5213 |
| 9,705,214 | B2 | 7/2017 | Tramet et al. | |
| 11,050,177 | B2 | 6/2021 | Schaefer et al. | |
| 2005/0020136 | A1 | 1/2005 | Johannes et al. | |
| 2009/0017660 | A1 * | 1/2009 | Braganza | H01R 4/22 439/276 |
| 2011/0124215 | A1 | 5/2011 | Yin et al. | |
| 2015/0202706 | A1 | 7/2015 | Brosnan et al. | |

FOREIGN PATENT DOCUMENTS

| | | | |
|---|---|---|---|
| CN | 104813543 | A | 7/2015 |
| CN | 106211629 | A | 12/2016 |
| CN | 106270913 | A | 1/2017 |
| CN | 110858686 | A | 3/2020 |
| EP | 0075402 | A1 | 3/1983 |
| GB | 2144390 | A | 3/1985 |

OTHER PUBLICATIONS

International Search Report and Written Opinion for International Application No. PCT/FR2018/050095, dated Mar. 20, 2018—11 pages.

Chinese Office Action for Chinese Application No. 201880007575.2, dated Apr. 24, 2020 with translation, 14 pages.

* cited by examiner

REMOVABLE DEVICE FOR RETAINING ELECTRICAL CONTACTS

CROSS REFERENCE TO RELATED APPLICATIONS

This application is the U.S. National Phase Application of PCT International Application No. PCT/FR2018/050095, filed Jan. 16, 2018, which claims priority to French Patent Application No. 1750374, filed Jan. 18, 2017, the contents of such applications being incorporated by reference herein.

FIELD OF THE INVENTION

The present invention relates to the field of electrical connection devices. More particularly, the invention relates to a removable device for retaining connector pins for positioning electrical contacts on a printed circuit board. It also relates to a method for placing connector pins on a circuit board.

BACKGROUND OF THE INVENTION

Connector pin electrical contacts and other electrical contacts, referred to as "flat" contacts, are elements that need to be held in place while they are being positioned on and connected to a PCB (printed circuit board).

There are two main technologies for connecting electrical contacts, such as connector pins, to a PCB.

To solder electrical contacts to a PCB, it is necessary for the distal ends of said electrical contacts to be positioned in through-holes made in said PCB and for said holes to be filled, around said distal ends, with a filler metal. The clearance between the distal end of an electrical contact and the edge of the hole accommodating said electrical contact needed for the filler metal used to attach the electrical contact to the PCB means that the electrical contacts have to be held in place. For this, it is known practice to use a block made of plastic material as a holder for said electrical contacts. This block is provided with a plurality of housings that are capable of accepting a number of electrical contacts and of retaining these contacts so that they may be connected inside the holes made in the PCB. Although soldering allows electrical connections that are well able to withstand large currents to be formed, the use of these blocks has a number of drawbacks, such as decreasing the effective area on the PCB that is available for electronic components (shadowing).

There is also what is referred to as press-fit technology, using PCBs provided with holes that are precisely sized so that an electrical contact can be inserted by force.

This press-fit technology, although affording a number of advantages with respect to soldered blocks, such as for example allowing electrical contacts to be positioned individually and hence these electrical contacts to be used with the utmost precision, nonetheless has a number of drawbacks, namely:

- extra PCB cost, as it requires correctly sized holes;
- a limited ability to withstand large currents;
- decreased effective useful space on the PCB due to the need to maintain non-usable spaces around the electrical contacts (the space being reserved for the placement jaws) such that, for example, it is not possible to connect other electrical contacts on the underside of the PCB in proximity to these press-fit connections.

Solutions have been proposed allowing electrical contacts to be held in place while they are being connected to a PCB using an electrical contact holder that may be removed after said contacts have been connected to the PCB. Although there are devices allowing the problem of available effective space on the PCB to be solved without requiring a block that remains permanently, these solutions are very specific. One example of such a removable holder is described in the document U.S. Pat. No. 5,373,626, incorporated herein by reference. This document describes a pin carrier for positioning male contact pins on a printed circuit board (PCB). The pin carrier has a plurality of tubular housings, each of which is configured to accept and to retain a male contact pin, this pin being inserted into a tubular housing such that only the end portion that is intended to penetrate the surface of the printed circuit board is exposed. The internal space of these tubular housings is sized such that the pins are retained by a frictional retaining force that is just sufficient to hold the male contact pins in place as they are being soldered to a PCB, but allows said pin carrier to be removed after the male contact pins have been soldered to a PCB.

The drawback of this solution is that the housings must be very precisely sized; just right for the dimensions of the pins to be retained. Moreover, it is clear that such a device cannot be reused indefinitely. Specifically, wear through friction inside the housings, and even from the first use, necessarily entails a loss of the retaining function allowing the pins to be held in place, unless a very large retaining force is provided which comes with the risk of the pin soldered to the PCB being ripped out as the holder is removed.

Such a device is therefore not adjustable from one pin type to another and cannot be reusable. Also, once again, the proposed solutions are not suitable for connecting individual electrical contacts.

Thus, no technology exists allowing individual pins to be connected to a PCB, as afforded by press-fit technology, while providing a strong electrical contact, as afforded by soldering.

SUMMARY OF THE INVENTION

An aspect of the present invention aims to provide a retaining device and a method for connecting pins to a PCB that are free of the drawbacks mentioned above.

According to an aspect of the invention, this by virtue of a removable device for retaining electrical contacts, noteworthy in that it comprises:

- a rigid element for holding electrical contacts including a plurality of housings that are configured to accept said electrical contacts, the lateral walls of said holding element that are adjacent to the housings having a plurality, of openings that each lead into one housing of the plurality of housings of the holding element; and
- an elastic element for retaining said electrical contacts in the holding element including a plurality of sprung blades that are arranged facing the openings leading into the housings of the rigid holding element so as to retain said electrical contacts in said housings of the holding element.

The device for retaining electrical contacts according to the invention affords a number of advantages. In particular:

- it allows the electrical contacts to be held in place during soldering operations, thus providing a sturdy solution without the use of a bulky block;
- it constitutes a flexible solution that is equivalent to press-fit technology allowing electrical contacts to be placed individually and precisely on a PCB without extra cost (this customization being managed on a pick-and-place machine for placing contacts on the carrier);

it allows the electrical contacts to be positioned precisely in all directions.

According to one advantageous exemplary embodiment, the holding element is made of a thermally stable material.

According to one advantageous exemplary embodiment, the holding element is made of a material exhibiting low thermal conductivity.

According to another preferred exemplary embodiment, the holding element is made of ceramic.

According to one advantageous exemplary embodiment, the holding element is made of "high-temperature" plastic material.

According to one advantageous exemplary embodiment, the holding element is made of "high-performance" plastic material.

According to one exemplary embodiment, the openings leading into the housings run along the entire height of said housings.

According to one preferred exemplary embodiment, the sprung blades of the elastic retaining element are made of "high-performance" metal.

According to one advantageous exemplary embodiment, the portion of the sprung blades of the elastic retaining element that is intended to make contact with an electrical contact is provided with thermal insulation.

According to one advantageous exemplary embodiment, the width of the distal end of the sprung blades of the elastic retaining element is greater than the width of the remaining part of said sprung blades.

An aspect of the present invention also relates to a method for connecting electrical contacts to a circuit board, noteworthy in that it implements a removable retaining device having any one of the features mentioned above.

According to one exemplary implementation, the method according to an aspect of the invention has the following steps:

a step of inserting the required number of electrical contacts into the housings of the rigid holding element;

a step of positioning the retaining device according to an aspect of the invention, including the electrical contacts retained by the sprung blades of the elastic retaining element, on the circuit board;

a step of connecting the electrical contacts to the circuit board;

a step of removing the retaining device once the electrical contacts are attached to the circuit board.

According to one preferred exemplary implementation, in the step of inserting the electrical contacts into the housings and in the step of removing the device according to an aspect of the invention after connecting the electrical contacts to the circuit board, the sprung blades are spread away from their rest position so as to reduce, momentarily, their contact with the electrical contacts and thus decrease the risk of damaging the surface of the contacts.

According to one preferred exemplary implementation, the step of connecting the electrical contacts to the circuit board is a soldering step.

BRIEF DESCRIPTION OF THE DRAWINGS

Other objects, features and advantages of aspects of the present invention will become apparent from the following description, provided by way of non-limiting example with reference to the appended drawings, in which.

DETAILED DESCRIPTION OF THE PREFERRED EMBODIMENTS

According to an aspect of the invention, this is achieved by virtue of a removable device 1 for retaining electrical contacts C, noteworthy in that it comprises:

a rigid element 2 for holding electrical contacts C; and an elastic element 3 for retaining said electrical contacts C in the holding element 2.

The rigid element 2 for holding electrical contacts C includes a plurality of housings 4, consisting of blind cavities, which are configured to accept said electrical contacts C. According to the illustrated exemplary embodiments, the rigid holding element 2 includes two rows of housings 4 arranged longitudinally. For example, the housings 4 are of suitable shape and size for the type of electrical contacts C that they are going to accommodate so as to ensure that said electrical contacts C are positioned properly.

Figure 1:
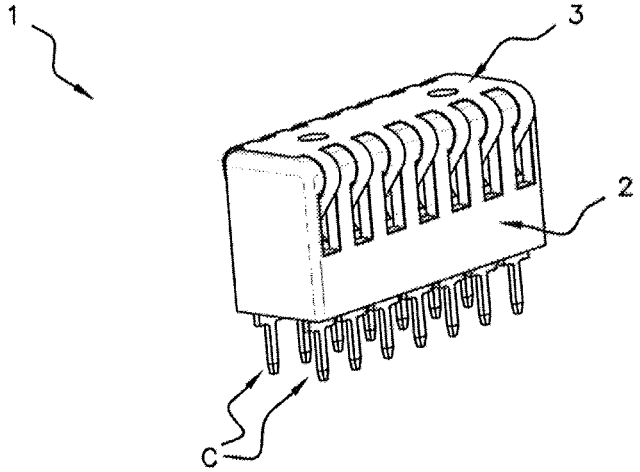
FIG. 1 is a perspective view of a first exemplary embodiment of the holder according to an aspect of the invention.
Figure 2:
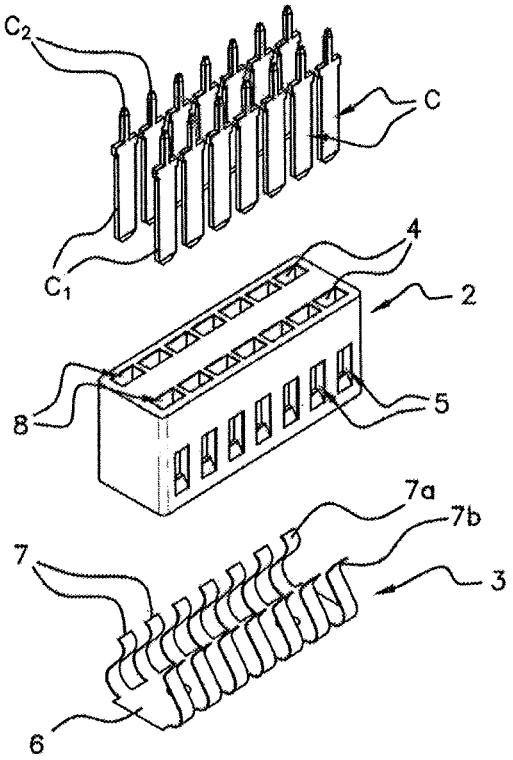
FIG. 2 is an exploded perspective view of the device according to an aspect of the invention illustrated in FIG. 1.
Figure 3:
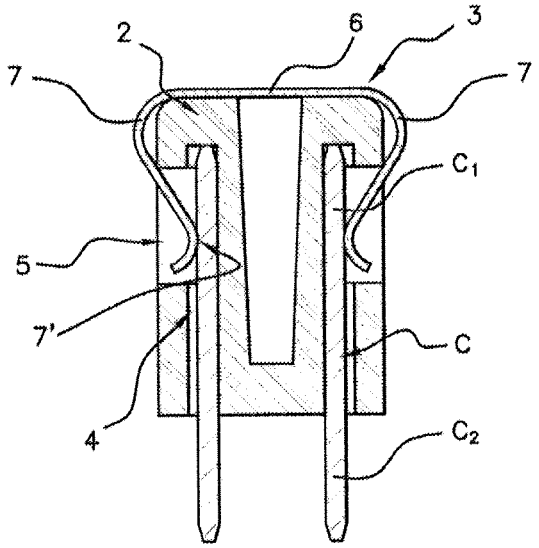
FIG. 3 is a cross-sectional view of the device according to an aspect of the invention illustrated in FIG. 1.
Figure 4:
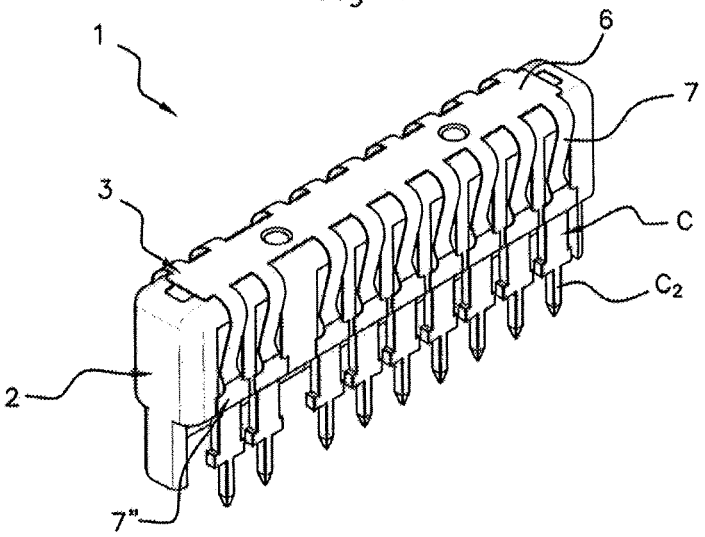
FIG. 4 is a perspective view of a second exemplary embodiment of the holder according to an aspect of the invention.
Figure 5:
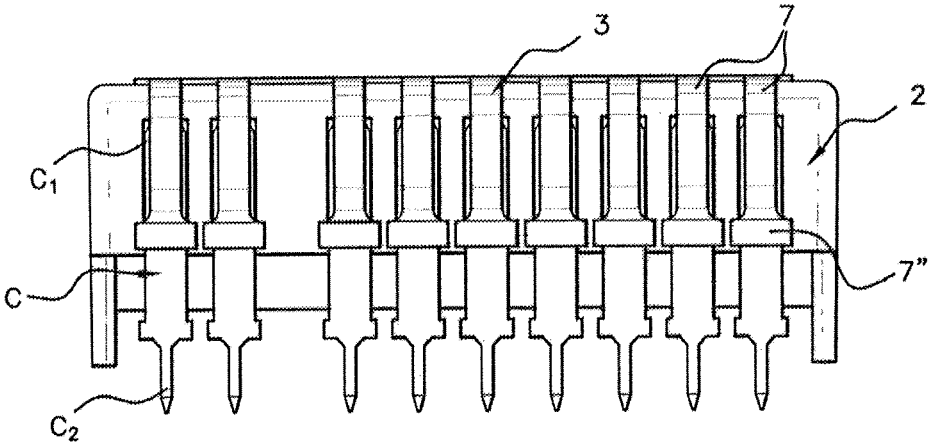
FIG. 5 is a side view of the device according to an aspect of the invention illustrated in FIG. 4.
Figure 6:
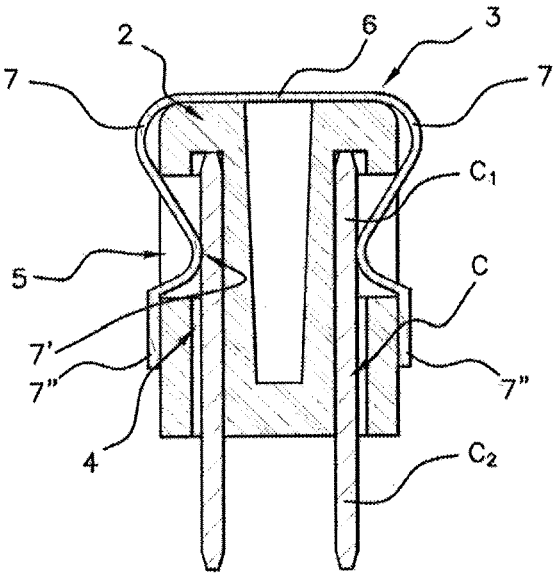
FIG. 6 is a cross-sectional view of the device according to an aspect of the invention illustrated in FIG. 4.

Advantageously, the longitudinal walls of the rigid holding element 2 have a plurality of openings or windows 5. Each opening 5 is arranged to lead into a housing 4. In the exemplary embodiment illustrated in FIGS. 4 to 6, the openings 5 run along the entire, or substantially the entire, height of said housings 4. Thus, potential contaminants may be expelled when the electrical contacts C are inserted into the housings 4. Moreover, this feature makes it possible to carry out certain checks (for example presence checks).

The lateral opening of the housings allows, in the case of a molded holder, the impact of molding flash on the geometry of the receptacles to be decreased.

According to the illustrated example, the elastic element 3 for retaining the electrical contacts C includes a longitudinal blade, the length of which is substantially identical to the length of the rigid holding element 2. The elastic element 3 for retaining the electrical contacts C further includes a plurality of sprung blades 7.

When the rigid holding element 2 and the elastic retaining element 3 are assembled together, said sprung blades 7 are arranged facing the openings 5 leading into the housings 4. Said sprung blades 7 are curved in shape, for example describing a normal "S" for the blades that are arranged on one side of the longitudinal blade 6 and describing a backward "S" for the sprung blades that are arranged on the other side of the longitudinal blade 6, or, expressed otherwise, each pair of sprung blades 7*a*-7*b* takes the shape of a lyre. The curvature of the sprung blades 7 is such that these blades pass through the openings 5 and penetrate into the housings 4. Thus, when an electrical contact C is positioned in a housing 4 of the rigid holding element 2, the sprung blades 7 bear, individually, against each electrical contact C so as to ensure that it is retained in its housing 4.

The spring action of the sprung blades 7 makes it possible in particular to compensate for variations in size, either from one type of electrical contact C to another, or from one electrical contact C to another for one and the same type of electrical contact C (the variations in size then being due to the variations that are typically encountered in mass production), this being achieved using one and the same elastic retaining element 3.

The sprung blades 7 may take any other shape allowing the same function of retaining the electrical contacts C to be obtained.

Thus, in a connection method, for example by soldering electrical contacts C to a circuit board:

- the required number of electrical contacts C are positioned in the housings 4, their insertion into said housings between an inner wall 8 of the housings 4 and the sprung blades 7 spreading these blades from their rest position outward toward the exterior of said housings 4, through the openings 5;
- the device 1, including the electrical contacts C thus held by the sprung blades 7 by their active part C1, is brought into position facing the circuit board and the connection ends C2 of the electrical contacts C are positioned facing holes in the circuit board that are intended to accept them;
- the electrical contacts C are thus held in place by the device 1 for the duration of a connection step, for example a soldering step known per se, allowing the electrical contacts C to be rigidly connected to the circuit board;
- once the electrical contacts C have been soldered to the circuit board, the device 1 is removed, leaving said electrical contacts C soldered to the circuit board.

Thus, the device 1 according to an aspect of the invention holds the electrical contacts C for the duration of the connection operation, for example by soldering, and, once these contacts are attached to the PCB, said device 1 is withdrawn, leaving the contacts in place on the PCB, the device 1 then being able to be reloaded with new electrical contacts C to be attached and reused, the steps of the method that are mentioned above then being repeated.

During the step of inserting the electrical contacts C into the housings 4 and the step of removing the holder after the electrical contacts C have been attached to the circuit board, the sprung blades 7 may be slightly spread away from their rest position so as to reduce, momentarily, contact between the blades 7 and the active parts C1 of the electrical contacts C, and thus avoid the risk of marking the active part C1 of the electrical contacts C.

Preferably, the holding element 2 is made of a thermally stable material exhibiting low thermal conductivity. For example, the holding element 2 is made of ceramic.

According to another exemplary embodiment, the holding element 2 is made of "high-temperature" plastic material and, if possible, of "high-performance" plastic material.

Preferably, the sprung blades 7 of the elastic retaining element 3 are made of "high-performance" metal so that they do not stick to the active part C1 of the electrical contacts C during the high-temperature soldering operation.

Advantageously, the portion 7' of the sprung blades 7 of the elastic retaining element 3 that is intended to make contact with the, active part C1 of the electrical contacts C is provided with thermal insulation. In this way, the surface treatments with which the electrical contacts C are generally provided are not damaged during the soldering operation (for example by reflow), thus avoiding the risk of welding the sprung blades 7 to the electrical contacts C.

The device 1 thus produced withstands the stresses of soldering, combining thermal resistance and geometric precision.

Advantageously, the width of the distal end 7" of the sprung blades 7 of the elastic retaining element 3 is greater than the width of the remaining part of said blades 7. This widened distal end 7" bearing against the rigid holding element 2 allows the sprung blades to spread apart as the electrical contacts C are placed or the retaining device 1 is removed after the soldering step.

The device 1 according to an aspect of the invention affords a number of advantages; in particular, it allows the layout density of circuit boards to be increased. Specifically, the surface-mount components may be arranged closer to the electrical contacts, both on the upper face and on the lower face of the circuit boards. Indeed, with the device 1 according to an aspect of the invention, the contact pads of the surface-mount components may be positioned less than a millimeter away from the solder pad of an electrical contact, whereas with the current solutions their minimum proximity is between 3 mm and 5 mm.

The reusable aspect of the device 1 according to an aspect of the invention allows substantial savings to be made with respect to the current solutions. In particular, the high level of automation and quality of the reflow soldering process allows waste to be decreased while increasing the rate of production.

Lastly, the device according to an aspect of the invention allows the electrical contacts C to be placed with greater precision than with the current solutions, in particular press-fit, since it is less dependent on the drill quality of the holes in the PCB as far as precision in the plane of the printed circuit board is concerned. Moreover, because of its stability, the device 1 according to an aspect of the invention allows better angular precision (in terms of tolerance at the active part of the electrical contacts C).

The invention claimed is:

1. A removable device for retaining electrical contacts, comprising:

- a rigid element for holding the electrical contacts including a plurality of housings that are configured to accept said electrical contacts, the lateral walls of said holding element that are adjacent to the housings having a plurality of openings that each lead into one housing of the plurality of housings of the holding element; and
- an elastic element for retaining said electrical contacts in the holding element including a plurality of sprung blades that are arranged facing the openings leading into the housings of the rigid holding element so as to retain said electrical contacts in said housings of the holding element.

2. The device as claimed in claim 1, wherein the holding element is made of a thermally stable material.

3. The device as claimed in claim 1, wherein the holding element is made of a material exhibiting low thermal conductivity.

4. The device as claimed in claim 1, wherein the holding element is made of ceramic.

5. The device as claimed in claim 1, wherein the holding element is made of plastic material.

6. The device as claimed in claim 1, wherein the holding element is made of plastic material.

7. The device as claimed in claim 1, wherein the openings leading into the housings run along an entire height of said housings.

8. The device as claimed in claim 1, wherein the sprung blades of the elastic retaining element are made of metal.

9. The device as claimed in claim 1, wherein a portion of the sprung blades of the elastic retaining element that is intended to make contact with an electrical contact is provided with thermal insulation.

10. The device as claimed in claim 1, wherein a width of the distal end of the sprung blades of the elastic retaining element is greater than a width of a remaining part of said sprung blades.

11. The device as claimed in claim 2, wherein the holding element is made of ceramic.

12. The device as claimed in claim 3, wherein the holding element is made of ceramic.

* * * * *